US007685798B2

(12) United States Patent
Marzocchi

(10) Patent No.: US 7,685,798 B2
(45) Date of Patent: Mar. 30, 2010

(54) METHOD AND A UNIT FOR PRODUCING BLISTER PACKS BY CUTTING A BLISTER BAND

(75) Inventor: Paolo Marzocchi, Gallo Bolognese Di Castel S. Pietro (IT)

(73) Assignee: I.M.A. Industries Macchine Automatiche, Ozzano Emilia (Bologna) (IT)

( * ) Notice: Subject to any disclaimer, the term of this patent is extended or adjusted under 35 U.S.C. 154(b) by 482 days.

(21) Appl. No.: 11/587,295

(22) PCT Filed: Apr. 28, 2005

(86) PCT No.: PCT/IB2005/001292

§ 371 (c)(1),
(2), (4) Date: Oct. 23, 2006

(87) PCT Pub. No.: WO2005/105574

PCT Pub. Date: Nov. 10, 2005

(65) Prior Publication Data

US 2008/0236109 A1 Oct. 2, 2008

(30) Foreign Application Priority Data

Apr. 29, 2004 (IT) ..... BO2004A0269

(51) Int. Cl.
*B65B 47/00* (2006.01)

(52) U.S. Cl. ..... 53/559; 53/453; 53/467

(58) Field of Classification Search ..... 53/471, 53/559, 540, 541, 467, 542, 558, 453, 266.1
See application file for complete search history.

(56) References Cited

U.S. PATENT DOCUMENTS

| | | | | | |
|---|---|---|---|---|---|
| 3,240,094 | A | * | 3/1966 | Van Endert | 83/636 |
| 3,577,700 | A | * | 5/1971 | Bippus et al. | 53/453 |
| 3,874,143 | A | * | 4/1975 | Braber | 53/412 |
| 4,338,083 | A | * | 7/1982 | Andrae | 493/239 |
| 4,477,243 | A | * | 10/1984 | Wallsten | 425/292 |
| 4,750,318 | A | * | 6/1988 | Matsuzawa | 53/559 |
| 4,981,058 | A | * | 1/1991 | Gavrun, III | 83/34 |

(Continued)

FOREIGN PATENT DOCUMENTS

DE 299 97 851 U1 8/1999

(Continued)

*Primary Examiner*—Thanh K Truong
(74) *Attorney, Agent, or Firm*—William J. Sapone; Cokeman Sudol Sapone P.C.

(57) ABSTRACT

A method and a relative unit (1) for producing blister packs (7) by cutting a blister band (4), according to which a band (4) with blisters (2) housing products is fed in a selected feeding direction (A), through subsequent stations: a band (4) verifying station, a closing station where the blister band is closed with a covering band, and to a cutting station (5) for cutting the closed blister band (4). In the cutting station (5), the closed blister band (4) is cut by progressive shearing, to obtain relative blister packs (7) detached from at least one strip (9*a*, 9*b*) or scrap longitudinal edge of the blister band (4). If portions of the blister band (4) considered unsatisfactory are detected in the control station, the subsequent shearing is performed partially or incompletely, so as to prevent detachment of the corresponding blister packs (8), considered faulty and destined to be rejected, from the strip (9*a*, 9*b*) of the band (4).

7 Claims, 7 Drawing Sheets

U.S. PATENT DOCUMENTS

| | | | | | |
|---|---|---|---|---|---|
| 5,155,981 | A | * | 10/1992 | Tordini | 53/559 |
| 5,409,368 | A | * | 4/1995 | Heiskell et al. | 425/301 |
| 5,776,297 | A | | 7/1998 | Edwards et al. | |
| 6,070,385 | A | * | 6/2000 | Antonio | 53/53 |
| 6,109,154 | A | * | 8/2000 | Miyatsu et al. | 83/627 |
| 6,152,007 | A | * | 11/2000 | Sato | 83/582 |
| 6,758,322 | B2 | * | 7/2004 | Monti | 198/433 |
| 2003/0136080 | A1 | | 7/2003 | Battisti | |
| 2005/0095099 | A1 | | 5/2005 | Gertitschke et al. | |

FOREIGN PATENT DOCUMENTS

| | | | |
|---|---|---|---|
| DE | 199 17 436 | A1 | 10/2000 |
| EP | 0466 660 | A1 | 1/1992 |

* cited by examiner

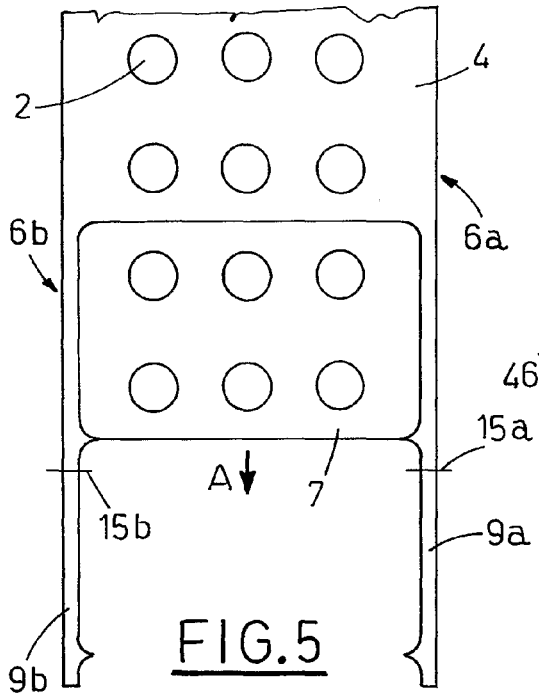
FIG.5
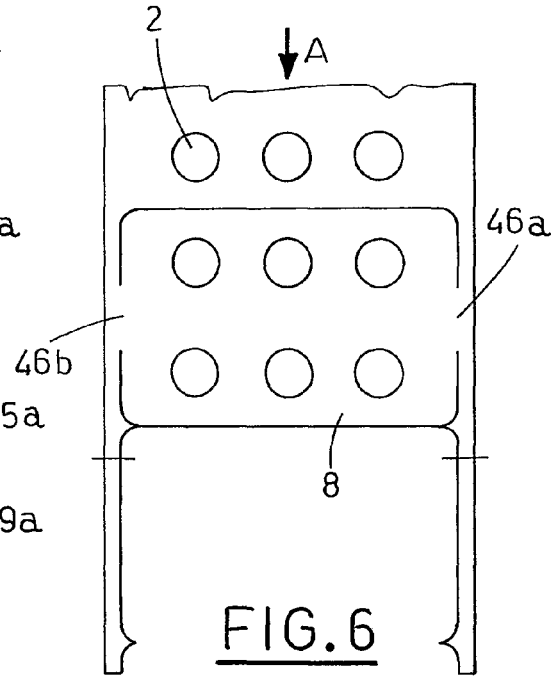
FIG.6
FIG.7
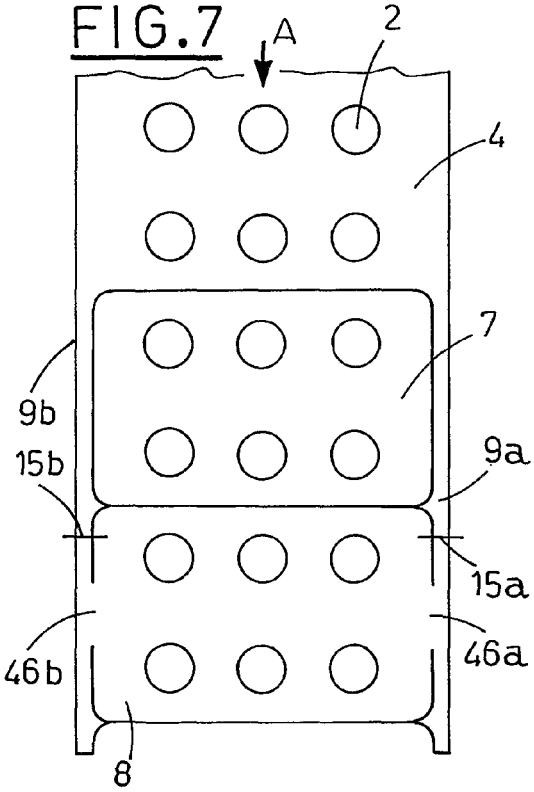
FIG.8
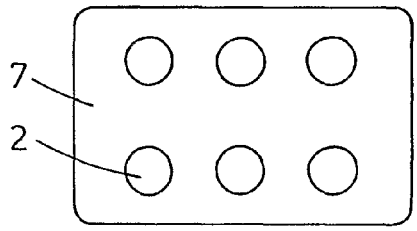
FIG.9
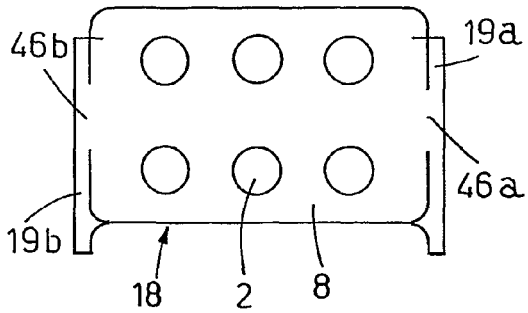

METHOD AND A UNIT FOR PRODUCING BLISTER PACKS BY CUTTING A BLISTER BAND

BACKGROUND OF THE INVENTION

The present invention relates to a method and a unit for producing blister packs by cutting a blister band.

In particular, the invention concerns producing blister packs containing pharmaceutical articles, such as tablets, capsules and similar, to which the following description will make explicit reference without losing the generality.

BRIEF DESCRIPTION OF THE PRIOR ART

In general, the blister packs used for packaging pharmaceutical articles are produced by packaging machines called blistering machines and are obtained by cutting adjacent portions of a blister band made of thermo-formable material, whose blisters contain the articles and are closed with a sealing band.

One or more groups of blisters, arranged one beside another, can be made on the used blister bands, from which one or more blister packs will be obtained, arranged side by side along the band.

For descriptive simplicity's sake, the following description will make reference to a blister band, from which only one row of blister packs is obtained.

At present, not only a visual verify is performed in order to find possible portions of the blister band with incorrect joining and/or printing, but also the correct filling of the blister band is visually verified after the band has been filled with the articles to be packaged.

The verify of the filling is performed by known devices and with known modes, to find possible groups of blisters which are empty, or not wholly filled, or filled with only fragments of articles, and which create faulty blister packs that cannot be sold.

The position of the incomplete, or anyway to reject, blister groups is registered in an electronic processing unit, in order to find these blister packs during any further operation, due to techniques and devices fitting for this purpose, such as encoders, meters, sensors, timers and the like.

After the correct filling has been checked, the band is closed with a sealing material, such as band of aluminium or of plastic material and the so obtained blister band is fed through a cutting station, where a punch and a die work in step relation with the feeding of the blister band, to cut single blister packs.

Thanks to the fact that it is possible to know, due to the above mentioned control devices, if the blister pack produced each time is good or faulty, it is also possible to decide the final destination of each blister pack; if the blister pack is good, it is sent to a boxing section, if it is faulty, it is collected in a rejection collector.

For the last operation, it is usually necessary to use a selection device situated downstream of the cutting station, between the cutting station and an inlet station of a line conveying the blister packs to the boxing section.

Such selection device of the currently used blister machines is usually complex and expensive and it causes considerable reduction of the production rate of the blistering machines.

The German patent document DE-U-29907851 describes a blistering machine for the production of blister packs, using technical measures aimed at avoiding an erroneous feeding of faulty blister packs to the boxing section.

According to these means, when a sensor, situated upstream of the cutting station, detects the presence of a faulty pack, suction cups of an arm used to transfer the blister packs, normally operated to grip the blister packs and to transfer them to a line of the boxing section, are deactivated.

This way, the faulty blister pack is not transferred and is made fall into a previously prepared container for collecting blister packs to be rejected.

However, in the blistering machine described in the above mentioned German patent document, it can happen that, during the rejection of the faulty blister packs, some of the faulty packs are accidentally reintroduced in the production cycle and are unintentionally boxed and sent to be sold.

Moreover, the above mentioned rejection container collects without distinction the completely empty blister packs as well as the partially empty blister packs, that is with some blisters filled with products: therefore, in order to get back the pharmaceutical products contained in the blisters, it is necessary to include a further step, performed manually, of separating the completely empty blister packs from the partially empty packs and then, still manual collecting the products, which results in considerable waste of time.

SUMMARY OF THE INVENTION

Consequently, the object of the present invention is to propose a method and a relative working unit, which overcomes the above described drawbacks.

In particular, an object of the present invention is to eliminate the additional means for removing blister packs downstream of the cutting station, and also to obtain blister packs, which cannot be in any way reintroduced into the production cycle, if detected faulty.

The present invention proposes a method for obtaining blister packs by cutting a blister band, including the following steps: feeding a band with blisters, housing products, in a prefixed feeding direction, through subsequent stations for verifying the band, for closing the band, in which the blister band is closed with a covering band, and to a station, in which the closed blister band is cropped; in correspondence to said cutting station, said closed blister band being cut by multi-step shearing, to obtain relative blister packs separated from at least one strip or longitudinal scrap edge of said blister band; the method being characterized in that, if portions of said blister band considered unsatisfactory are detected in said control station, said subsequent shearing is performed partially or incompletely, so as to prevent the detachment of the corresponding blister packs, considered faulty and destined to be rejected, from said strip of said band.

The present invention relates also to a unit for producing blister packs by cutting a blister band, which includes conveying means, aimed at feeding a band having blisters, which house the products, in a prefixed feeding direction through the subsequent stations for verifying the band, for closing the band, where the band is closed with a covering band, and a cutting station, where the closed blister band is cropped; cutting means, situated in said cutting station and acting on said closed blister band to perform a cut by multi-step shearing, so as to obtain relative blister packs detached from at least one strip or longitudinal scrap edge of said blister band; the unit being characterized in that said cutting means include at least one primary cutting section and at least one secondary cutting section;

if portions of said blister band considered unsatisfactory are detected in said control station, said secondary cutting station is made ineffective, so as to prevent the detachment of the corresponding blister packs, considered faulty and destined to be rejected, from said strip of said band.

BRIEF DESCRIPTION OF THE DRAWINGS

The invention will be described in the following with reference to a preferred, but not exclusive embodiment of a unit carrying out the proposed method, shown in the enclosed Figures, in which:

FIGS. 5, 6 and 7 show different positions assumed by a blister band during its passage through the working station of FIG. 1;

FIGS. 8 and 9 show a blister pack suitable to be sold and, respectively, a faulty blister pack, obtained by the unit proposed by the present invention.

BEST MODES OF CARRYING OUT THE INVENTION

Figure 1:
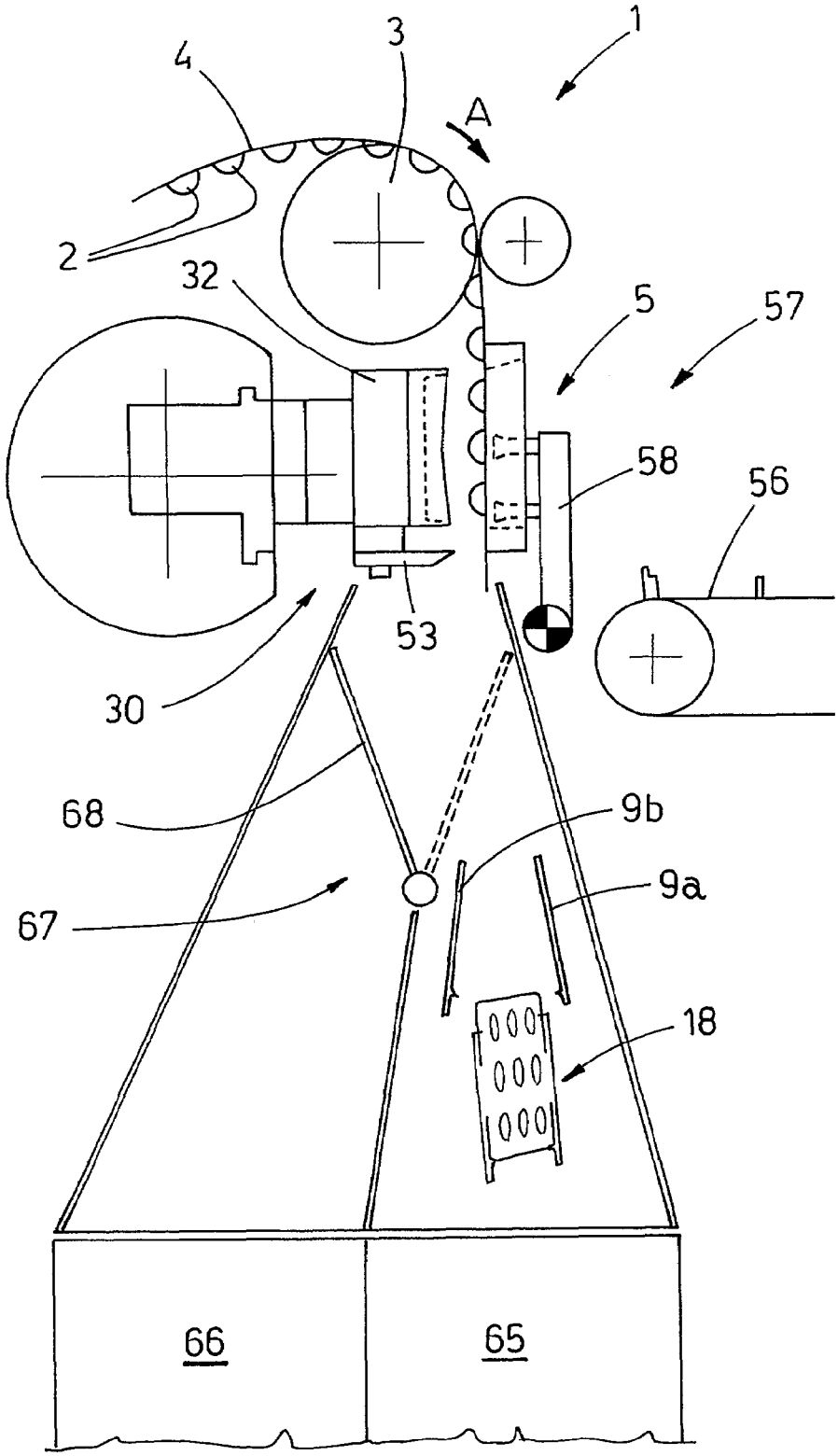
FIG. 1 is a schematic, partially section view with some parts removed for clarity's sake, of a working station of the proposed unit and carrying out the claimed method.

Regards FIGS. 1, 2, 3 and 4, the reference numeral 1 indicates a working unit, which is capable of carrying out the proposed method for producing blister packs 7 containing pharmaceutical products (not shown).

In particular, the unit 1 produces the packs 7 by multi-step cutting a closed blister band 4, featuring the blisters 2, obtained by thermo-forming according to a known and not shown technique, and filled with the pharmaceutical products before the band 4 has been sealed by coupling with the closing band.

Moreover, the unit 1 is aimed at performing, as it will be better explained later, a selection operation between the correct blister packs 7 and faulty blister packs 8.

Actually, the unit 1 allows to separate and to maintain strictly divided the faulty blister packs 8 aimed at being rejected, that is packs with no one or not all blisters 2 completely filled with products, or packs, in which one or more blisters 2 contain fragmented products (for example, broken pharmaceutical pills), from the correct blister packs 7, in which all the blisters 2 are completely filled with entire products and which can be subsequently boxed and sent to be sold.

Moreover, the unit 1 is capable of rejecting portions or strips 9 (Figures from 5 to 9) of the blister band or scraps obtained by the cutting operation, so that they can be recycled afterwards.

According to FIGS. 1, 2, 5 and 6, a driving roll 3 is operated to feed the sealed blister band 4 in a feeding direction A.

The shown examples and the following description refer to a blister band 4 having only one longitudinal row of blister packs 7, as shown in FIGS. 5, 6 and 7, but it is obvious that, by applying some necessary changes, the claimed invention can be used also with the bands having more rows of groups of blisters, one next to another, from which more blister packs, one beside another, will be obtained.

Figure 11:
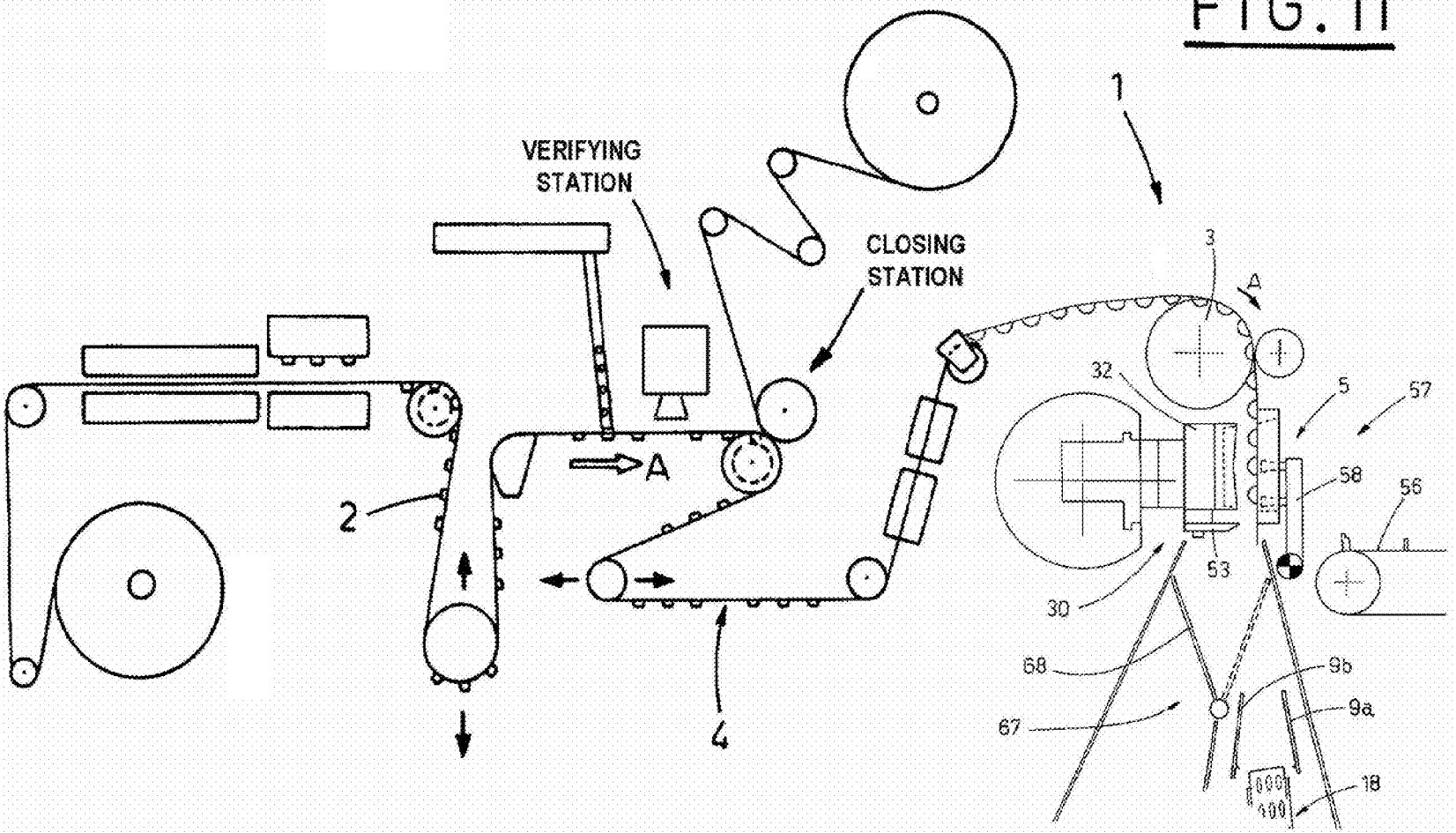
FIG. 11 shows an overall view of a machine including the unit of the present invention.

In operation, after the band with blisters 2 has been filled with pharmaceutical products and before it is sealed, as mentioned above, known technique includes a verify of the correct filling of the blisters 2: precisely, this verify, performed by the use of optical devices or similar of known type (shown in FIG. 11), situated in a detection and control station, allows to find empty blisters 2 or blisters containing damaged or fragmented products, and thus detects and memorizes the exact area of the band 4, in which the empty blisters 2 or filled with damaged products are situated.

The area, which was detected faulty, is memorized in a suitable memory area of a central processing unit connected to the above mentioned verify devices, so that the subsequent blister pack containing such empty area or filled with damaged products, can be afterwards rejected.

Downstream of the detecting and controlling station, the band 4 is then sealed and fed through a cutting station, indicated with the reference number 5 in Figures from 1 to 4, and being integral with the unit 1.

The band 4 is cropped in the station 5, to obtain blister packs 7.

According to what is shown in Figures from 1 to 4, the cutting station 5 includes moving cutting means 30, defined by a punch 32, which moves alternately, and whose working head defines a cutting area 33, aimed at defining the border of the blister pack 7.

The punch 32 works together with a fixed die 38, in step relation with the feeding of the blister band 4, which is made transit between the punch 32 and the die 38.

According to the embodiment shown in Figures from 1 to 4, the band 4 transits through the cutting station 5 in a vertical direction A and the punch 32 is operated in a crosswise direction, that is horizontal.

It is understood that the claimed invention can be applied also in case, in which the band 4 runs through the cutting station 5 oriented in a different way, and the punch 32 is operated in directions different from the ones shown and described.

When the punch 32 is operated in the crosswise direction, the cutting area 33 enters the hole of the die 38, so as to shear the blister band 4 and thus obtain a relative blister pack 7, as shown in FIG. 8.

The progress of this operation has been schematically shown in FIG. 5, where it is possible to see the band 4, a blister pack 7 being formed by shearing the band 4, and the empty area on the band 4 left free due to the shearing and subsequent separation of the previously made blister pack 7.

The advancement of the blister band 4 through the cutting station 5 is performed by a pitch which is equal to the width of the blister packs 7 to be formed, so as to avoid waste of material between the adjacent blister packs.

According to what has been better shown in FIGS. 5 and 7, strips 9*a*, 9*b* of waste material scraps along the longitudinal edges 6*a*, 6*b* after each shearing.

The strips 9*a*, 9*b* reproduce a complementary form of the cut blister packs 7 profile.

According to what is shown in Figures from 1 to 4, the unit 1 includes transferring means 57, situated near the die 38 for taking blister packs 7 cut and separated from the band 4.

Figure 3:
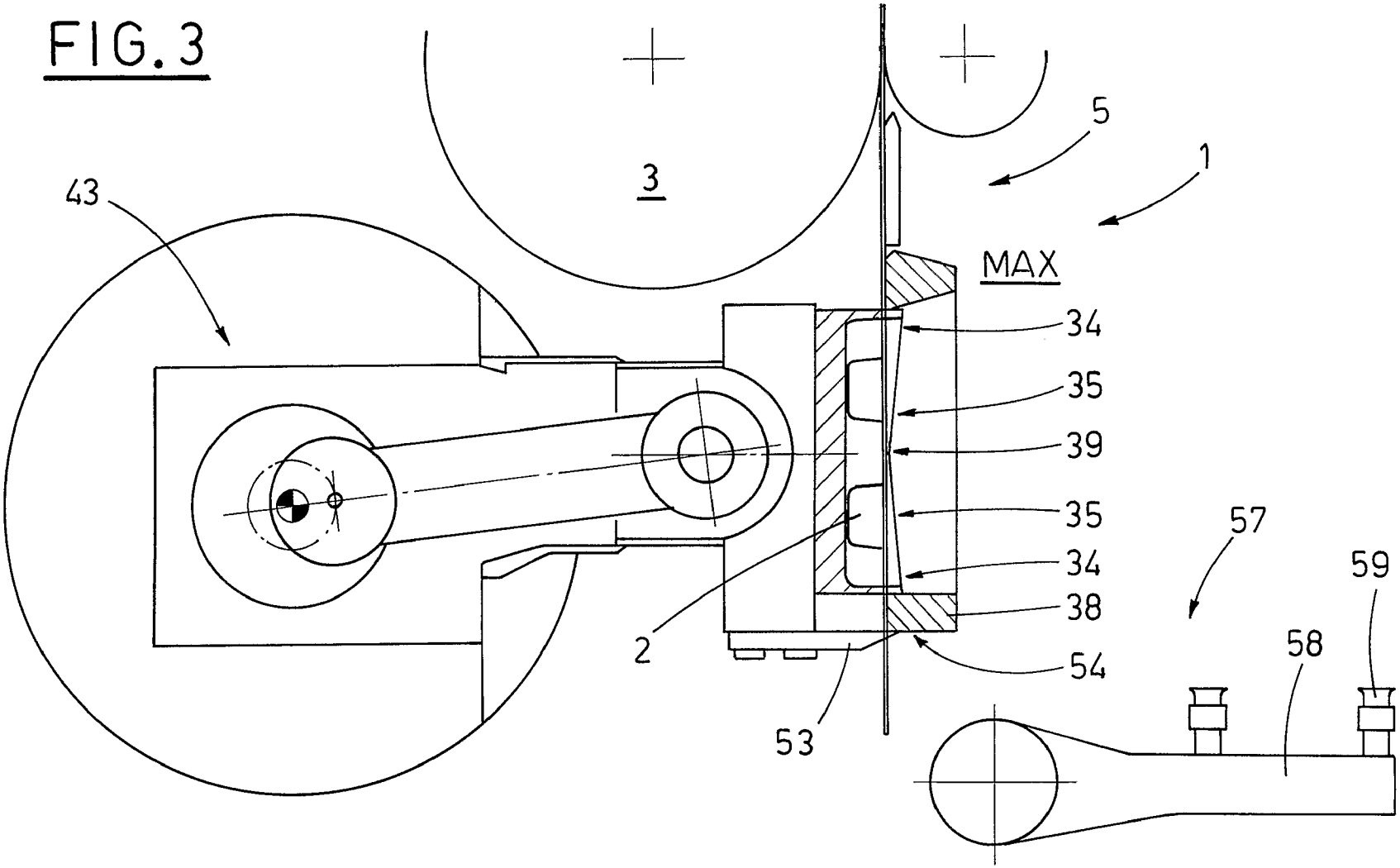

The transfer means 57 include an oscillating arm 58, which has picking up means, such as e.g. suction cups 59 (FIG. 3).

The arm 58 is made oscillate, in step relation with the operation of the punch 32, between a pick up position, shown in FIG. 1, in which the suction cups 59 hold the blister pack 7, and a release position (FIG. 3), in which the pack 7 is released and deposited on a feeding line 56 of a packaging section, outer to the unit 1 (FIG. 1).

Figure 2:
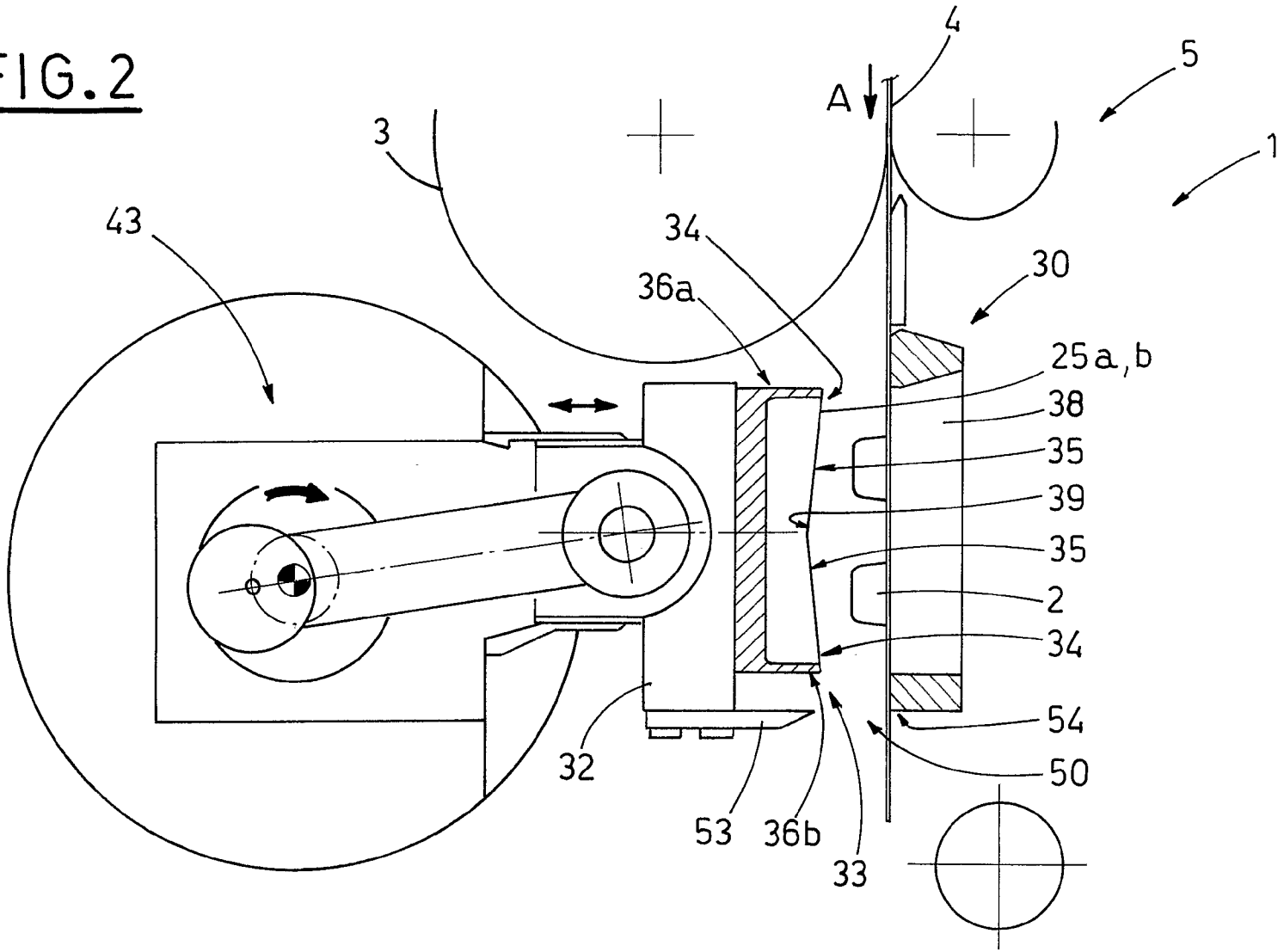
FIGS. 2, 3 and 4 are enlarged and detailed views of the working station of FIG. 1, in some of the characteristic operation steps.

According to what is shown in FIGS. 2 and 3, and in FIG. 9, additional cutting means 50 are situated adjacent to the punch 32 and supported by the latter, in order to subdivide the strips 9*a*, 9*b* of waste material or scraps, thus obtaining pieces 19*a*, 19*b*.

The additional cutting means 50 include a pair of blades 53, fastened at the side of the punch 32: the above mentioned Figures show only one blade 53, because the other is exactly identical and symmetrical.

In this way, since the blades 53 are carried by the same punch 32, they act in synchrony, or contemporarily with the operation of the punch 32 and do not require other operation means.

In order to cut the strips 9*a*, 9*b*, the blades 53 act in cooperation with an outer cutting edge 54 of the stationary die 38, as it is well seen in FIG. 3.

The pieces 19*a*, 19*b*, obtained by cutting the strips 9*a*, 9*b*, are collected in suitable containers in a way explained later.

Figure 10A:
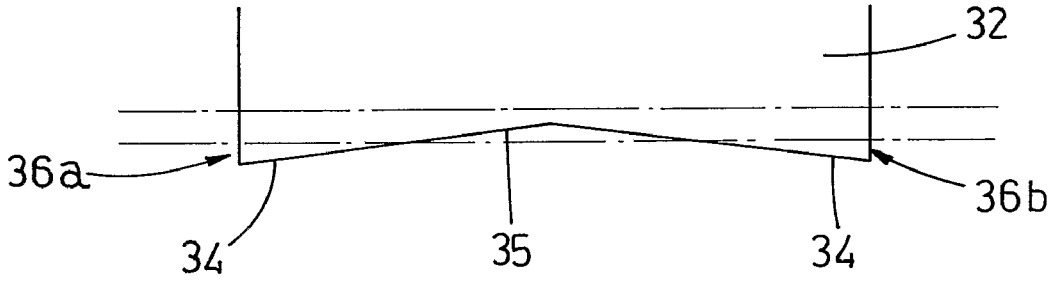
FIGS. 10*a*, 10*b* and 10*c* show three possible alternative variants of a particular of the working station shown in Figures from 1 to 4.

In accordance with the unit 1 of the invention as shown in Figures from 1 to 4 and in FIG. 10*a*, the cutting area 33 (FIGS. 1 and 2) of the punch 32 has preferably a "V" shape, with two respective cutting lines inclined one with respect to the other with symmetrical inclinations and intersecting in a point 39.

The cutting area 33 has a primary cutting section 34 and a secondary cutting section 35.

Figure 4:
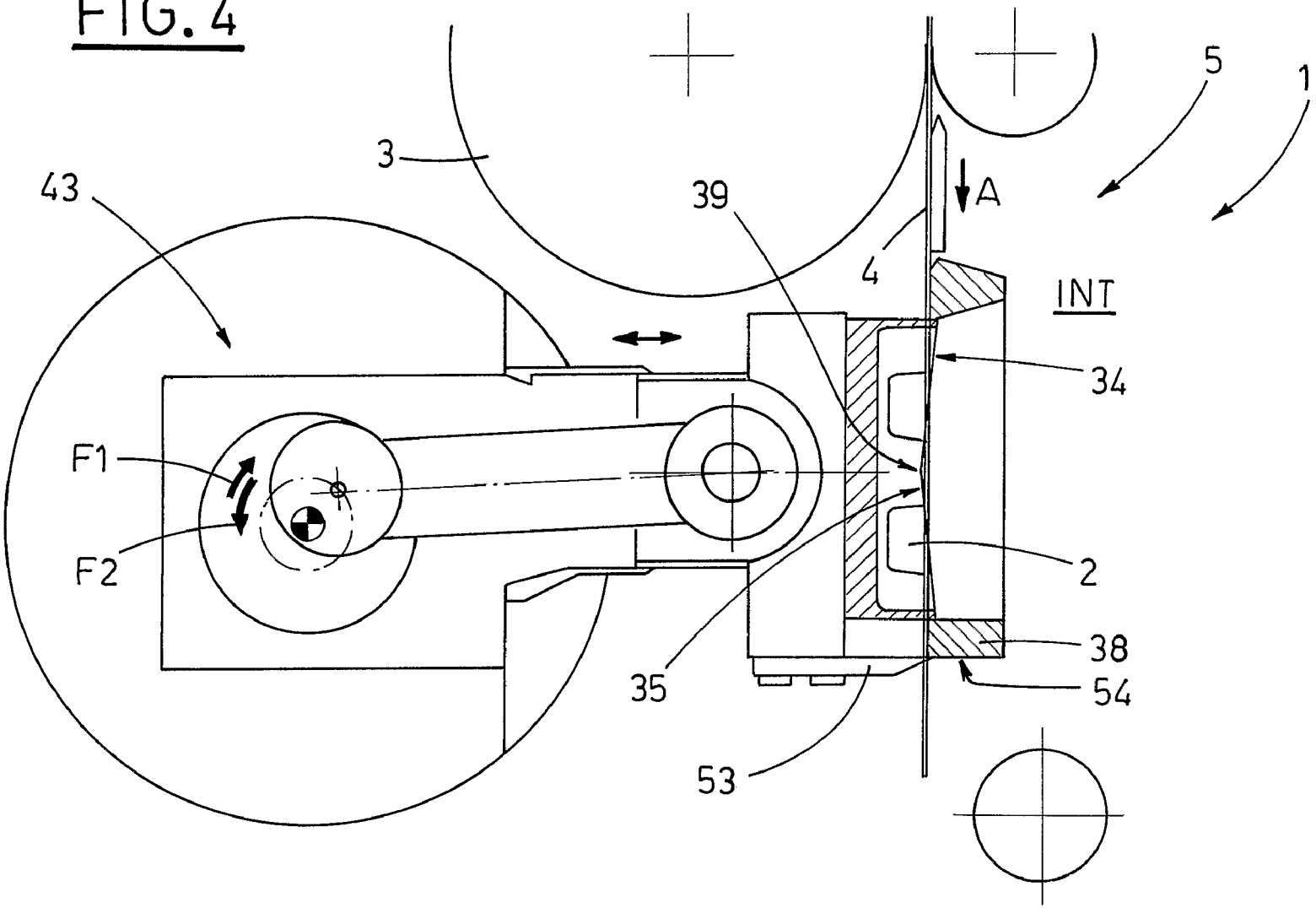

More in detail, the primary cutting section 34 includes substantially the lateral portions of the "V"-like cutting area and the secondary cutting area 35 is substantially defined by the central portion of the "V"-like cutting area 33 including the intersection point 39, as shown in FIGS. 2, 3 and 4.

The difference between the two cutting sections 34 and 35 lies in the fact that the primary cutting section 34 is aimed at acting on the band 4 always and anyway, during the movement of the punch 32 toward the band 4, in order to cut the band 4, while the secondary cutting section 35, in rear position with respect to the primary section 34 considering the motion direction of the punch 32, crosswise to the direction A and due to the "V" shape of the cutting area 33, is to act on the band 4 to cut it only in given operation conditions, that is when the band 4 has been previously detected satisfying, that is with all the blisters 2 filled with pharmaceutical products detected perfectly entire, according to what will be explained better in the following.

In other words, the precise object of the missing action of the secondary cutting section 35 on the band 4 is to leave the joining areas 46*a*, 46*b* between the blister pack 8 detected faulty and at least one, preferably both, strips 9*a*, 9*b* of waste material or scraps.

This condition can be easily seen in FIG. 6.

In this way, as it will appear clear from the following, and in particular from the description of the method carried out by the present device, the faulty packs 8 are brought to continue their way together with the strips 9*a*, 9*b* of the scrap material.

This can be seen in FIGS. 7 and 9, which show the band 4 with one faulty pack 8, partially cut, but not separated from the strips 9*a*, 9*b*: therefore, the faulty blister pack or packs 8, joined to the strips 9*a*, 9*b* in positions corresponding to the areas 46*a*, 46*b*, are not picked up by the suction cups 59 of the arm 58, suitably deactivated.

In order to obtain the non-operation of the secondary cutting section 35 of the punch 32 on the band 4, the invention includes the following aspects.

A first aspect refers to the activation of the punch 32, which is operated by a crank mechanism 43, known in itself, to move between a non-operative rest position (FIG. 2) and a working position (FIG. 3), indicated with MAX, in which the punch 32 reaches the maximum stroke, to cut completely the band 4, thus obtaining correct blister packs 7.

Between the above mentioned non-operative position and the MAX position, the punch 32 reaches an intermediate position, indicated with INT (FIG. 4), in which the section 35 is deactivated, as in the rear position and with the portions of the band 4 to reject, that is during production of the faulty blister packs 8 to be rejected.

For this purpose, as it has already been mentioned before, the punch 32 is connected to a driving mechanism 43, the well known crank mechanism, which moves the punch 32 to and from the band 4 crosswise to the band 4 feeding direction A.

Therefore, with a complete rotation of 360° of the crank mechanism, the punch 32 performs a complete stroke reaching the above mentioned MAX position, while, when the rotation (arrow F1 in FIG. 4) imposed to the crank mechanism 43 is stopped, controlled by the control units which have detected portions of the band 4 to reject, in a point corresponding to about 325° rotation, the punch 32 stops at its intermediate position INT; afterwards, the crank mechanism 43 is made rotate in the opposite direction, so as to bring the punch 32 back to its beginning non-operative position (arrow F2 of FIG. 4).

Preferably, this type of control of the crank mechanism 43 operation is performed by a known brush-less motor, according to known techniques.

A second aspect relates to the already mentioned V-shape of the cutting area 33 of the punch 32, and according to it, as already described above, the primary cut section 34 is defined along such an extension, as to engage with the die 38 at the end of the punch 32 maximum stroke MAX, as well as with an intermediate stroke INT; whereas the extension of the secondary cutting section 35 is such that it engages with the die 38, and consequently with the band 4, only when the punch 32 performs its maximum stroke MAX, while during the intermediate stroke INT, the secondary section 35 is ineffective, so as to prevent the complete detachment of the blister pack 8 from the strips 9*a* and 9*b*.

In particular, in order to obtain all these effects, the secondary cutting section 35 is displaced with respect to an ideal transversal plane of the punch 32, on which the primary cutting section 34 lies.

As described above, the secondary cutting section 35 is inclined with respect to the above ideal transversal plane, on which at least the major part of the primary cutting section 34 lies.

More precisely, the primary cutting section 34 extends on the side 36*a* of the punch 32 that is transversal with respect to the band 4 and the punch 32 is turned in the direction opposite to the band 4 feeding direction A.

The primary cutting section 34 extends at least between two points 25*a*, 25*b* of the cutting area 33, situated on the sides of the punch 32, which are longitudinal with respect to the band 4, and corresponding to the cutting areas 15*a*, 15*b* (FIGS. 5 and 7), on which the blades 53 act when they cut the strips 9*a*, 9*b* of the waste material.

Consequently, the secondary cutting section 35 originates from, or close to, two above mentioned points 25*a*, 25*b*, situated on the longitudinal sides and corresponding to the cutting areas 15*a*, 15*b* on the strips 9*a*, 9*b*.

Preferably, the secondary cutting section 35 includes two sections of the cutting area 33, inclined with respect to the transversal section of the punch 32 in the direction opposite to the die 38.

The origin of the secondary cutting section or sections 35 is suitably situated near the points 25*a*, 25*b*, because the primary cutting section 34 extends in fact beyond these points, in order to assure the separation of the faulty packs 8 from the strips 9*a*, 9*b* still joined to the band 4, at the points 15*a* and 15*b* (FIG. 7).

It is possible to see from FIGS. 5, 6 and 7 that the primary cutting section 34 includes also the opposite cutting edge 36*b* of the punch 32 turned in the same blister band 4 feeding direction A, although actually, this part of the punch 32 does not perform any cutting operation on the band 4, since the band 4 feeding pitch is equal to the width of the blister packs.

However, the punch 32 would be operative if the blister band 4 feeding pitch were bigger than the width of the obtained blister packs 7.

Figure 10B:
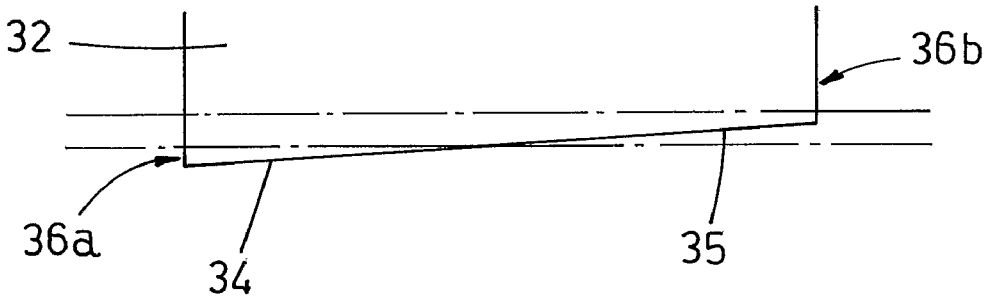
Figure 10C:
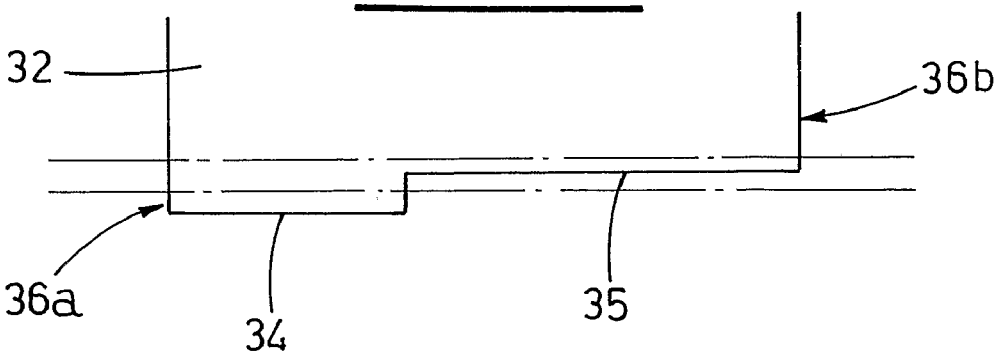

In accordance with FIGS. 10*b* and 10*c*, the cutting area 33 of the punch 32 has different conformations than the "V"-like shape previously mentioned and shown in Figures from 1 to 4 and in FIG. 10*a*: according to a possible variant shown in FIG. 10*b*, the area 33 is defined by a straight inclined cutting line 33, with inclination oriented from the side 36*a* toward the side 36*b*, that is from the primary section 34 situated above toward the secondary section 35 situated below.

According to the possible variant shown in FIG. 10*c*, the cutting area 33 is defined by a step conformation 33, in which the upper portion on the side 36*a* is the primary cutting section 34, while the lower portion of the step on the side 36*b* is the secondary cutting section 35.

According to FIG. 1, downstream of the cutting station 5 with respect to the band 4 feeding direction, the unit 1 includes also a first rejection container 65, in which strips 9*a*, 9*b* are collected as well as groups 18 defined by pieces 19*a*, 19*b* obtained by cutting of the strips 9*a*, 9*b* and joined to faulty blister packs 8, which have all the blisters 2 empty.

The unit 1 includes also a second rejection container 66, for collecting groups 18 defined by pieces 19*a*, 19*b* obtained by cutting of the strips 9*a*, 9*b* and joined to the faulty blister packs 8, which have at least one blister 2 filled with an entire product or with the fragments thereof.

Moreover, the unit 1 includes selection means 67, which select the above strips 9*a*, 9*b* and/or groups 18 to send them alternatively to the respective rejection containers 65, 66.

In particular, the means 67 include a baffle 68 controlled in relation to the detection of the faulty blister packs 8 completely empty and of the faulty blister packs 8 not completely filled or containing not entire or fragmented products.

Therefore, in use, the baffle 68 is operated by known and not shown motor means, which move it between two extreme lateral positions, that is on one side, to send pieces of waste material 19*a*, 19*b* and groups 18 (FIG. 9) defined by completely empty blister packs 8 with corresponding pieces of waste material 19*a*, 19*b* joined thereto, to the first rejection container 65, situated below, and on the other side, to convey groups 18 defined by blister packs 8 not completely filled or containing not entire or fragmented products with corresponding pieces of waste material 19*a*, 19*b* joined thereto, to the second rejection container 66.

The rejection container 65, which has been filled with the pieces of waste material 19*a*, 19*b* and completely empty blister packs 8 is advantageously emptied, in order to recycle the waste material (scraps).

The partially filled blister packs 8 are withdrawn from the other rejection container 66, in order to be advantageously and rapidly emptied, so as to recycle the pharmaceutical product, as well as the already completely empty blister packs 8, together with the scraps 9*a*, 9*b*.

It is to be pointed out that a big advantage can be obtained due to the fact that there is no risk to reintroduce unintentionally the packs 8 destined to the product recycle, into the packaging cycle, because the outer conformation of the correct blister packs 7 is completely different from the outer conformation of the faulty blister packs 8, which in no way can be packaged (with regard to this, see the considerable conformation difference between the blister pack 7 of FIG. 8 and the faulty blister pack 8 joined to the pieces 19*a*, 19*b* of FIG. 9).

Consequently, since only the satisfying blister packs 7 can be and are withdrawn by the suction cups 59 of the arm 58, solely the same blister packs 7 are put by the arm 58 onto the packaging line 56, on which other rejection blister group is no longer required, as it occurs in the currently known machines, with consequent considerable reduction of the production speed.

The unit 1 operates substantially in the following way: a blister pack 8 to be considered faulty and subsequently rejected is cut only partially, so as to prevent it from detaching from the strips 9*a*, 9*b*, that is the faulty blister pack 8 must necessarily continue its forward movement, as it is connected to the strips 9*a*, 9*b* of the waste material.

During shearing of the strips 9*a*, 9*b* in the station 5, simultaneously with the incomplete cutting, a group 18 is obtained (FIG. 9), defined by the faulty blister pack 8 and two pieces of waste material 19*a*, 19*b*, connected to the sides of the faulty blister pack 8 by the joining areas 46*a*, 46*b*.

In particular, according to the method, the partial cutting of the faulty blister pack 8 occurs by a reduction of the cutting area 33 of the punch 32 brought to cut the blister band 4.

As it appears from the description of the unit 1, the reduction of the cutting area 33 is obtained by a limitation of the effective stroke of the punch 32, so that the primary cutting section 34 of the punch acts on the blister band 4 to cut a correct pack 7, as well as to cut a faulty pack 8.

On the other side, the secondary cutting section 35 of the punch 32 is brought to act on the blister band 4 only in order to cut off completely a correct blister pack 7 from the band 4.

According to the above described method, by arranging the secondary cutting section 35 in a displaced (rear) position with respect to the ideal transversal plane, on which the major part of the primary cutting section 34 lies, in particular by producing it inclined with respect to the above plane, and varying the extension of the punch 32 stroke between the two above mentioned values MAX and INT, it is possible to cut off completely the blister pack 7, with the maximum stroke MAX (FIG. 3), or only partially with the intermediate stroke INT (FIG. 4).

The method proposed by the present invention is completed by the characteristic feature, according to which cutting of only pieces of waste material 19*a*, 19*b* from the strips 9, as well as cutting of the pieces 19*a*, 19*b* connected partially to a faulty blister pack 8 occurs by the same blades 53 operated by the same punch 32.

This allows the use of the same means already present on the punch 32 by the activating mechanism 43, without installing further additional cutting means.

Consequently, the prefixed objects are fulfilled, because there are no means, which must remove the faulty blister packs downstream of the cutting station, as it occurs in the prior art.

Moreover, due to the particular configurations obtained by the use of the above described unit and method, the produced faulty blister packs can be in no way confused with the correct blister packs, and consequently there is no risk that the faulty blister packs can be reintroduced into the working cycle and packaged.

Only the correct blister packs can proceed toward the subsequent packaging operations.

The so conceived invention can be also a subject of many changes and variants remaining within the inventive scope; all the details can be substituted with technically equivalent elements.

The invention claimed is:

1. A unit (1) for producing blister packs (7) by cutting a blister band (4), the unit having conveying means (3) for feeding a band (4) having blisters (2) containing products, in a selected feeding direction (A) through subsequent stations for verifying said band (4), for closing said band (4) with a covering band, and to a cutting station (5), where the closed blister band (4) is cut; the unit further comprising:

cutting means (30) situated in said cutting station (5) and acting on said closed blister band (4) to progressively shear said band so as to obtain blister packs (7) detached from at least one strip (9*a*, 9*b*) or from at least one longitudinal edge of said blister band (4); the cutting means (30) having at least one primary cutting section (34) and at least one secondary section (35); means for detecting if portions of said blister band (4) are faulty in a control station, said secondary cutting station (35) being made ineffective, so as to prevent detachment of the faulty blister packs (8), said faulty blister packs being destined to be rejected from said strip (9*a*, 9*b*) of said band (4);

said cutting means (30) including punch means (32), which move with a reciprocating motion to and from motionless die means (38) in a direction substantially transversal to said feeding direction (A), in order to cut said band (4); said punch means (32) having said primary cutting section (34) and said secondary cutting section (35); said cutting means supporting further sectioning and cutting means (50) for forming cutting points (15*a*, 15*b*) on said strip (9*a*, 9*b*), while simultaneously cooperating with said die means (38) and with said punch means (32); and, said punch means (32) being movable alternatively between a rest position and a position defined by a maximum stroke (MAX) and through a position defined by an intermediate stroke (INT); said primary cutting section (34) being defined along a cutting area (33) of said punch means (32), along such an extension, as to be engaged with said die means (38) in a position corresponding to the maximum stroke (MAX), as well as in a position corresponding to the intermediate stroke (INT); said secondary cutting section (35) being defined along a cutting area (33) of said punch means (32), along such an extension, so as to engage with said die means (38) only in a position corresponding to said maximum stroke (MAX).

2. The unit as claimed in claim 1 wherein said cutting area (33) of said punch means (32) has a "V"-shape, having cutting lines inclined with respect to each other and intersecting at a determined point (39).

3. The unit as claimed in claim 2 wherein said primary cutting section (34) includes substantially lateral portions of said "V"-like cutting area (33) and said secondary cutting section (35) is defined substantially by a central portion of said "V"-like cutting area (33) including the intersection point (39).

4. The unit as claimed in claim 1 wherein said cutting area (33) of said punch means (32) is defined by a straight cutting line inclined with inclination oriented from said upper primary section (34) toward said lower secondary section (35).

5. The unit as claimed in claim 1 wherein said cutting area (33) of said punch means (32) is defined by a step conformation (33), in which an upper part is said primary cutting section (34), while a lower part is said secondary cutting section (35).

6. The unit as claimed in claim 1 wherein said punch means (32) are operated to move alternatively by a crank mechanism (43).

7. The unit as claimed in claim 1 further comprising first rejection container means (65), for collecting said strips (9*a*, 9*b*) and groups (18), defined by pieces (19*a*, 19*b*) obtained by cutting the strips joined to the faulty blister packs (8), which have all the blisters (2) empty; second rejection container means (66) for collecting groups (18) defined by the pieces (19*a*, 19*b*) obtained by cutting the strips (9*a*, 9*b*) joined to said faulty blister packs (8), which have at least one blister (2) filled with a complete product or with fragments thereof selection means (67) for selecting said strips (9*a*, 9*b*) and/or groups (18) for sending them to their respective rejection container means (65, 66).

* * * * *